US005509242A

United States Patent [19]

Rechsteiner et al.

[11] Patent Number: 5,509,242

[45] Date of Patent: Apr. 23, 1996

[54] STRUCTURAL INSULATED BUILDING PANEL SYSTEM

[75] Inventors: Steven A. Rechsteiner; Jesse Fuller, both of Barrington, Ill.

[73] Assignee: American International Homes Limited, Hoffman Estates, Ill.

[21] Appl. No.: 222,645

[22] Filed: Apr. 4, 1994

[51] Int. Cl.[6] ..... E04B 2/00; E04B 5/00; E04B 7/00

[52] U.S. Cl. ..... 52/270; 52/91.3; 52/93.2; 52/220.2; 52/262; 52/274; 52/284; 52/287.1; 52/293.3; 52/300; 52/309.7; 52/309.9; 52/309.16

[58] Field of Search ..... 52/91.1, 91.3, 52/92.1, 92.2, 93.2, 101, 220.2, 220.3, 262, 270, 274, 283, 284, 293.3, 300, 309.7–309.11, 309.16, 592.1, 592.4, 220.4, 264, 268, 267, 281, 287.1, 288.1, 220.7, 220.5

[56] References Cited

U.S. PATENT DOCUMENTS

| | | | |
|---|---|---|---|
| 1,141,021 | 5/1915 | Taylor | 52/262 X |
| 1,536,977 | 5/1925 | Skipworth | 52/91.3 X |
| 2,095,434 | 10/1927 | Calkins | 52/92.2 X |
| 2,142,060 | 12/1938 | Miner | 52/592.1 X |
| 2,315,989 | 4/1943 | Tennison et al. | 52/101 X |
| 2,347,756 | 5/1954 | Swenson | 52/293.3 |
| 3,196,499 | 7/1965 | Houyner | 52/91.3 X |
| 3,535,844 | 10/1970 | Glaros | 52/309.9 X |
| 3,641,720 | 2/1972 | Berrie | 52/309.1 X |
| 3,667,180 | 6/1972 | Tischuk | 52/592.4 X |
| 3,714,747 | 2/1973 | Curran . | |
| 3,760,548 | 9/1973 | Saver et al. | 52/592.1 |
| 3,797,190 | 3/1974 | Widdowson | 52/592.4 |
| 3,998,024 | 12/1976 | Frandsen | 52/592.1 |
| 4,037,377 | 7/1977 | Howell et al. | 52/592.1 X |
| 4,100,710 | 7/1978 | Kowallik | 52/592.4 X |
| 4,184,301 | 1/1980 | Anderson et al. | 52/592.4 X |
| 4,261,143 | 4/1981 | Rizzo | 52/91.1 X |
| 4,365,453 | 12/1982 | Lowe | 52/91.3 X |
| 4,373,312 | 2/1983 | Kim . | |
| 4,435,934 | 3/1984 | Kim . | |
| 4,738,067 | 4/1988 | Froseth . | |
| 4,743,488 | 5/1988 | Ting | 52/309.9 X |
| 4,872,297 | 10/1989 | Hetzel et al. | 52/91.1 |
| 4,936,069 | 6/1990 | Hunter et al. . | |
| 4,936,078 | 7/1990 | Porter | 52/592.1 |
| 5,056,290 | 10/1991 | Alexander et al. . | |
| 5,245,803 | 9/1993 | Haag | 52/262 X |
| 5,247,770 | 9/1993 | Ting . | |
| 5,274,974 | 1/1994 | Haag | 52/283 X |
| 5,277,002 | 1/1994 | Haag | 52/90.1 |
| 5,277,011 | 1/1994 | SerranoMartin | 52/309.9 X |
| 5,373,678 | 12/1994 | Hesser | 52/592.1 |

*Primary Examiner*—Robert J. Canfield
*Attorney, Agent, or Firm*—Gordon K. Anderson

[57] ABSTRACT

A building panel system which has a panel to panel connection utilizing opposing male and female joints formed integrally with the external and internal side of structural composite panels. Also, reinforcing splines (32) embedded in the foam between the panel skins. A panel to floor connection utilizes a Z-shaped section (42) with an anchor member (44) embedded into a concrete floor slab or foundation wall. A panel to roof connection uses an angle member (52), trough (56) and shelf (60) joined together with threaded fasteners (38). A panel to roof rail structural connection utilizes the same troughs (56) and inside and outside roof connectors (70) and (72). Thermobreak strips (54) are employed to prevent thermal feedthrough and caulking (40) is used as a vapor barrier in all connections.

22 Claims, 4 Drawing Sheets

STRUCTURAL INSULATED BUILDING PANEL SYSTEM

TECHNICAL FIELD

The present invention relates to prefabricated modular composite building panels and connections therebetween, in general. More specifically, panel to panel, floor and roof connections incorporating construction to assure structural integrity, and the elimination of vapor and thermal feedthrough.

BACKGROUND ART

Previously, many types of joint connections have been used in endeavoring to provide an effective means for producing a strong, yet vapor tight union between panels that precludes excessive heat transfer from the outside ambient into the building structure.

In most cases, the prior art has been directed to complex mechanical structure in combination with sealing or insulating material. A search of the prior art did not disclose any patents that read directly on the claims of the instant invention, however, the following U.S. patents are considered related:

| Patent No. | Inventor | Issue Date |
|---|---|---|
| 5,247,770 | Ting | Sep. 28, 1993 |
| 5,056,290 | Alexander et al | Oct. 15, 1991 |
| 4,936,069 | Hunter et al | Jun. 26, 1990 |
| 4,738,067 | Froseth | Apr. 19, 1988 |
| 4,435,934 | Kim | Mar. 13, 1984 |
| 4,373,312 | Kim | Feb. 15, 1983 |
| 3,714,747 | Curran | Feb. 6, 1973 |

Ting, in U.S. Pat. No. 5,247,770, teaches a wall joint having at least one mini-corrugation within joining metal surfaces of a female groove and a flared male leg interfacing with the corrugation interlocking the panel together.

In U.S. Pat. No. 5,056,290, issued to Alexander et al, the connector between two panels forms a sealing material reservoir and cavities. This reservoir facilitates even application of sealant to the connection.

Hunter et al discloses a pair of opposing legs with an insulating bridge therebetween in U.S. Pat. No. 4,936,069. The bridge defines a non-continuous space to minimize transfer of heat from one facing sheet to the other.

Froseth, in U.S. Pat. No. 4,738,067, discloses a roof panel with various water impervious layers. A frame along the opposite edges allows affixing one to the other.

Kim's U.S. Pat. No. 4,435,934 teaches joints between adjacent panels and support members secured by self-drilling fasteners. Metal strips embedded in the panels provide anchors for the fasteners. An insulating member on one edge of each panel provide support and a thermal barrier.

Kim's earlier U.S. Pat. No. 4,373,312 discloses panels assembled together in edge to edge relationship with complementary mating edges for securement. The joints employ self-drilling fasteners and the same insulating member is employed.

U.S. Pat. No. 3,714,747 of Curran utilizes lapped interfitted segments of double-skin foam core building panels. The side segments preclude externally visible fasteners by the use of a clip and fastener attaching an inboard side segment of the panel to the subgirth of a structural framework.

While the prior art, in most cases, uses a composite panel made of metallic skins inside and out with insulation inbetween, the actual joint connections differ greatly from the instant invention.

DISCLOSURE OF THE INVENTION

The industry is continually looking for improvements in the insulated metal building panel discipline in thermal insulating performance, sealing to prevent vapor pressure differentials, including moisture latent air infiltration and performance against flame spread and smoke development. All of these improvements have already been incorporated in the instant invention in simple and easy to accomplish methods, however, structural integrity against wind loads has historically been an equally important, or even a major consideration in the use of this type of building system. Structural interlocking joints have been made in the past to provide the needed strength, however in most cases, the approach has led to a complex arrangement with many components and considerable hand labor to assemble each panel together and each panel must be selected for its actual location, i.e. inside or outside, load bearing or non-load bearing, etc.

It is, therefore, a primary object of the invention to provide a structural insulated building panel system that permits the same panel to be used on any and all wall, roof and certain floor surfaces and, in a second embodiment, without respect to inside or outside of an exterior wall, as the panels are formed with mating joints that are mirror images of each other, therefore, attachment may be made regardless of the surface, as long as the joint is opposed. This same object of using an interchangeable or universal panel on all walls, ceilings, and floors is further developed in all embodiments by the use of a field installed reinforcing spline. This structure is either an angle or a channel that is cut to size in the field from one continuous length of material and is physically inserted in the area between the outside sections that are formed to make the structural joint. The structural void contains only the structural foam which has been foamed in the factory to permit the insertion of the reinforcing spline. The size of the angle or channel, along with its thickness, may be easily determined by the specific loading requirements for each individual panel and its application. As an example, the reinforcement for the exterior walls will be different than for the roof ridge and interior non-load bearing walls, etc. It may be easily seen that with this novel system the advantage of flexibility and simplicity of manufacture advances the state-of-the-art in basic structural insulated building panel fabrication and assembly.

An important object of the invention is directed to the smooth uncluttered appearance of the joint as its reinforcing splines are hidden inside and the mounting fasteners are also hidden from view underneath an overlapping fold in the skin of the panel itself. The position and number of the reinforcing splines may vary from one to four separate elements per joint, each being attached to the formed skin with the appropriate number and size of threaded fasteners depending upon the structural strength required. In any event, the position of each element, when either an angle or a channel is used, its location is such that a thermobreak is allowed inbetween having insulation separating the metal structure precluding a direct flow path for heat transfer from one surface to another. Further, each joint is caulked internally and on the exposed surface which does not effect the appearance, however, a vapor barrier is achieved precluding air and moisture from penetrating the joint. Another feature of this object is that each panel includes an electrical conduit for internal wiring that is either centered within or near the inside surface skin of the panel. This conduit is preferably a thermoplastic material, such as polyvinylchloride, which permits access by drilling a hole through the panel into the conduit with a hole saw. This conduit is centered laterally in the panel permitting easy location from the surface, as no other indication as to its position is apparent, leaving the exterior of the panel smooth and unmarred and yet, accessible for internal wiring.

Another object of the invention is a unique attaching connection of the joined panels to a concrete floor slab or foundation wall. This joint is made using a Z-shaped formed metal section partially embedded in concrete continuously around the perimeter of the building. This section provides a true, flat, level bearing surface to accept the connected panels. Each individual panel is connected to the Z-section with two or more self-drilling and tapping fasteners penetrating directly through the panel into the metal section. An insulating block is positioned behind the vertical surface of the section permitting the fasteners to pass completely through the metal, thus utilizing the major root diameter of the fastener itself beyond the tapered self-drilling and tapping tip and, therefore, provides maximum anchorage of the panel. In special instances where increased resistance to "up-lift" is required, the vertical surface of the Z-section may be increased in length in order to permit additional fasteners to be utilized. An anchor member is attached to the bottom portion of the Z-section and is completely surrounded by concrete, holding the section permanently in place. The extending end of the anchor is bent downward away from the top surface of the concrete to assure ample strength in the embedment. As in the panel to panel joint connection, at least three beads of caulking are normally applied in order to create the infiltration integrity. In the areas where it may be required by code or necessity a separate flashing or insect guard may be installed between the bottom on the panels and the Z-section. Structures with raised flooring will be normally constructed according to local building codes. No exterior finish of foundation walls is necessary, as the wall panels ordinarily extend to the finished grade level.

Still another object of the invention is the new method of attaching the panel to the roof. This attaching joint uses an overlapped interior wireway trough in conjunction with a roof mounting shelf member. This combination not only serves as lateral reinforcement to the tops of the panels, but also as a wireway for electrical wiring, etc. The shelf member is attached to the combination with threaded fasteners and provides the proper roof pitch angle to the attachment of the roof panels. Each joint at the exterior perimeter wall to roof connection of the building is provided with one or more thermobreak strips, thus preventing the transmission of heat or cold through the joint. The wireway, or open trough, is located along the entire joint providing a recessed duct open on the top only to receive and store electric or electronic wires, coaxial cables, antenna wiring, internal sound systems, etc., with easy access to the conduit inside, as previously described. It should be noted that a plastic grommet is inserted in the drilled hole from the wireway to the conduit to prevent chaffing of the wires on the bare metal skin. A cover is fastened from the outside vertical surface of the wireway to a flange on the roof mounting shelf serving two purposes, enclosing the wire trough and making it possible to use fasteners penetrating completely through the joint from the outside, thus providing greater strength to the building and component interconnection as the protruding fastener ends are now covered.

Yet another object of the invention is the ease of building erection, as the system utilizes conventional floor framing techniques for floors that are raised and the base Z-section is easily cast into the slab or foundation wall. No special lifting or rigging equipment is required for setting the wall panels and only conventional hand or hand-held power tools are necessary for the entire process.

The wall and roof panels are light in weight and easily handled by two people. Once again, no special equipment is required for carrying or holding the panels while securing them in place. The interior portion of the joints in all exterior walls are caulked, set in place, and secured prior to placement of the roof components. Cutting of the panels, if necessary, is accomplished with a conventional hand-held power saw.

The roof ridge connection could, in some cases, require a separate structural beam. This structural beam is constructed of one or more sections of the insulated structural panel material depending upon the size of the opening. These sections are easily handled without special equipment. However, standard methods of structural framing may optionally be used. Once installed, the roof panels are caulked, placed, and secured to the beam and the wall panels. The roof panels are made of the same materials as the wall panels and are also easily handled without special equipment. If the roof ridge beams use the standard panels, reinforcing is accomplished in both the upper and lower flange areas using a double trim angle. This procedure obviously eliminates the requirement for other trades, materials, or equipment at the project site.

Window and door openings are either pre-cut or cut in place at the project-site. Windows and doors are installed after the installation of the roof panels is completed.

Once all panels have been assembled and doors, windows and trim have been installed, all interior and exterior joints, and openings are sealed with a suitable caulking material. The wall panels are normally factory prime painted only to allow for the application of any other surfacing, such as field applied stucco type finishes or any other exterior surfacing, including vinyl or cedar siding, masonry veneer for the walls and wood or composition shingles for the roof. Interior walls may be painted or traditional drywall systems added. The combinations of finish are almost limitless, however, the ease of erection is paramount in this building system.

A further object of the invention is the cost effectiveness of the system and its interconnecting joints. Since the connections are easily made, erection man hours are minimal, and no special labor skills are required, and handling may be accomplished by one or two workers. Reduced number of trades required at the project site facilitate scheduling and permit more efficient use of construction personnel since there is no structural sub-framing and framing required. As an example, it has been found that a 3-bedroom residence of approximately 1000 square feet may be erected complete with interior and interior finish in less than 400 man hours. Further, the simplicity of each joint and readily available tooling makes individual panels, reinforcing splines, structural formed members, etc., economical to produce, as well as the economies of scale for large volume as the similarity of design utilizes many of duplicated shapes and forms.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
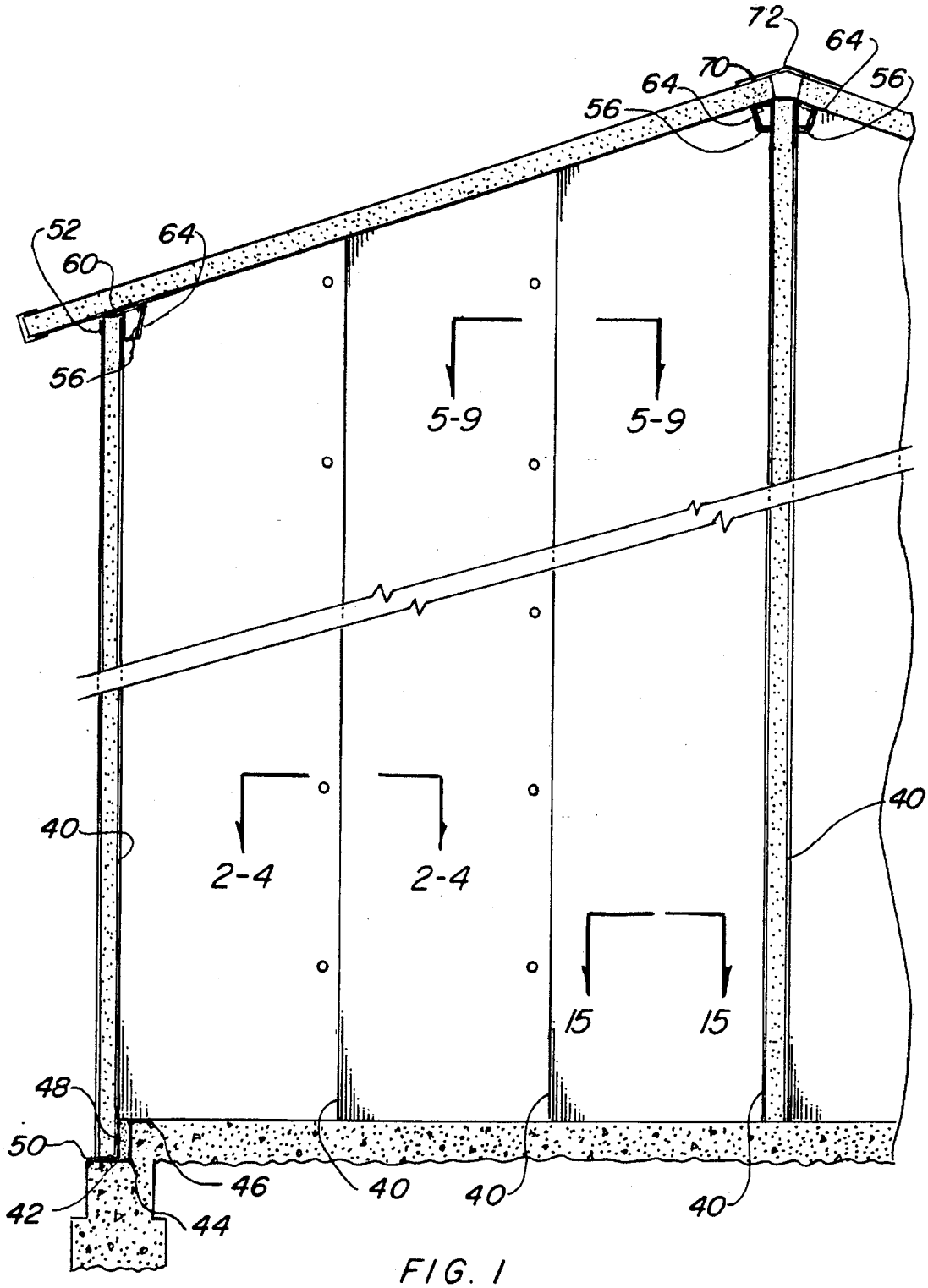
FIG. 1 is an elevational view of the inside of a building structure using the preferred building panel system including all of the panel connections.

The best mode for carrying out the invention is presented in terms of a preferred embodiment with a second embodiment in the panel to panel connection joint.

The preferred embodiment, as shown in FIGS. 1 through 4 and 10 through 15, is comprised of a structural building panel system assembled from composite panels having an insulating foam core of generating 2.5 pound per square foot density polyisocyanurate foam sandwiched between an outside 22 gauge, 0.033 inch (0.853 mm) thick metal skin and an inside skin of the same thickness plated with so-called G-90 galvanized finish. The system consists of the panel to panel connections and connections to floor, roof and roof ridge, in order to assemble a building structure.

The entire building panel system is representively illustrated in FIG. 1 view in cross-section from the inside looking toward the opposite wall.

Figure 2:
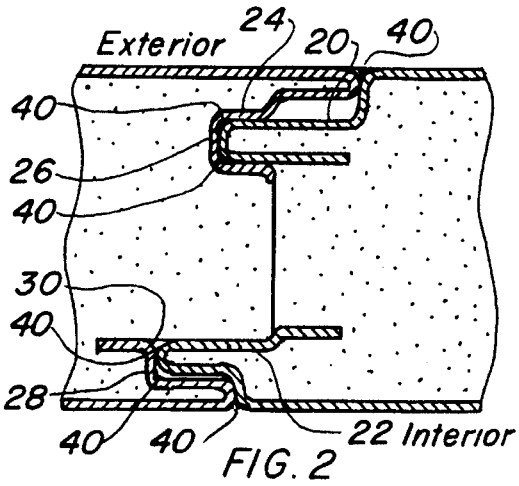
FIG. 2 is a cross-sectional view taken along lines 2—2 of FIG. 1 illustrating the preferred panel to panel connection.
Figure 3:
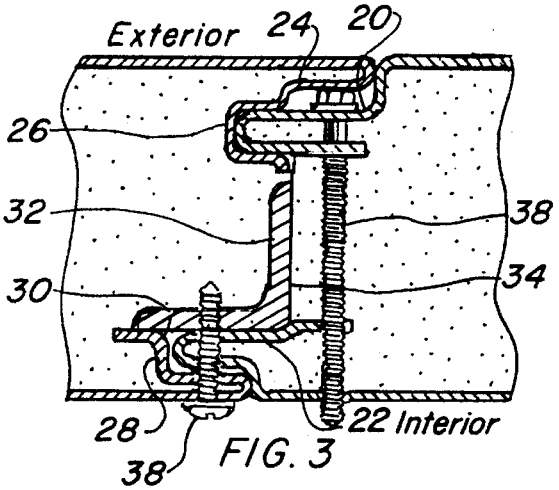
FIG. 3 is a cross-sectional view taken along lines 3—3 of FIG. 1 illustrating the preferred panel to panel connection with an angle reinforcing spline added.
Figure 4:
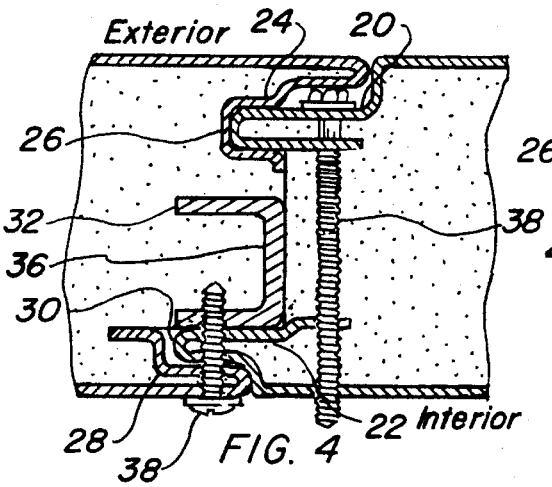
FIG. 4 is a cross-sectional view taken along lines 4—4 of FIG. 1 illustrating the preferred panel to panel connection with a channel reinforcing spline added.
Figure 5:
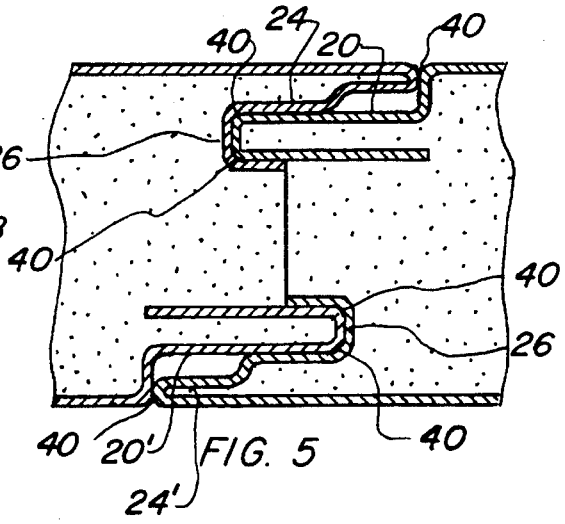
FIG. 5 is a cross-sectional view taken along lines 5—5 of FIG. 1 illustrating a second embodiment of the panel connection.
Figure 6:
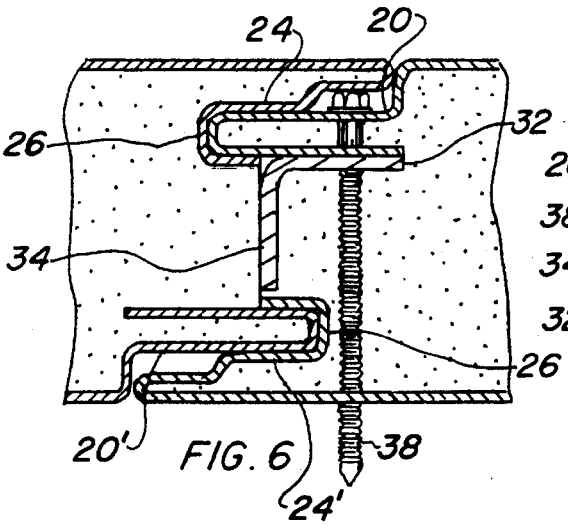
FIG. 6 is a cross-sectional view taken along lines 6—6 of FIG. 1 illustrating a second embodiment of the panel connection with an angle reinforcing spline added.

The panel to panel connection, or joint, is shown in FIGS. 2 through 4, with the basic construction depicted in FIG. 2. The outside skin of the panel is formed integrally into a channel shaped projection 20 located vertically along one end with the unattached leg extending inwardly into the panel. On the opposite side of the same end is a channel shaped extension 22 joggled parallel with the outside skin, slightly thinner than the projection 20 and basically opposite in location with the unattached leg of the channel extension extending inwardly into the panel. The pair of structural shapes forming male junction members.

The other end of each panel contains female cavities that mate with the male members in the form of a U-shaped leg 24 having a joggle formed therein parallel to the outside skin, with the leg extending outwardly from the joint. A female recess 26 is also integrally formed in the material. On the opposite side of the same end is a Z-shaped finger 28, also formed from the parent panel skin by overlapping or hemming and joggling upwardly and inwardly into a Z-shape. The finger 28 and a recess in the foam insulation form a socket 30 parallel with the extended finger. When two panels are urged together on opposed ends, the male projection 20 and extension 22 penetrate the recess 26 and socket 30 creating a metal to metal structural joint. Since no contact is made between the inside and outside skins, no thermal feedthrough is made.

In order to increase the structural integrity of the joint and to make the entire panel stronger for load bearing walls and to achieve satisfactory wind loading characteristics, a reinforcing spline 32 is added to the connection. This spine 32 may be in the form of a spline angle 34 depicted in FIG. 3, or a channel 36, shown in FIG. 4. In any event, this reinforcing spline 32 is preferably added in the field by simply cutting to length and pressing into the foam insulation. One leg of the spline 32 is contiguous with the internal leg of the channel shaped extension 22 and is attached completely through the channel shaped extension 22 and into one leg of the reinforcement spline channel 36 shown in FIG. 4 or into one leg of the spline angle 34 in FIG. 3, with a short threaded fastener 38. The fasteners 38 are preferably of the self-tapping type. The location size and number of fasteners 38 is dependent upon the size and thickness of the spline 32 to achieve the desired strength and rigidity. The long threaded fasteners depicted in FIGS. 3 and 4 extend completely through both the panel exterior and interior surfaces adding strength and assuring parallel relationship of the panel without a spline 32. It will be noted that the fastener heads on the exterior are enclosed within a space between the projection 20 and the leg 24, as depicted in FIGS. 3 and 4.

In order to eliminate vapor pressure feedthrough and create a moisture seal at each joint, caulking compound 40 is applied in the recess 26 and socket 30, as well as the visual joint between the projection 20 and the leg 24, also extension 22 and finger 28. This caulking 40 is well known in the art and is applied easily in the form of a bead from a compressible tube or other acceptable means, such as an air powered mechanical pump, etc.

A second embodiment of the same panel to panel connection is illustrated in FIGS. 5 through 9 and utilizes the same projection 20 and leg 24 on the exterior of the panel, as shown. The difference is that in this embodiment the interior of the panel is exactly the same using the projection 20' and leg 24', except in mirror image. This embodiment, therefore, uses the same basic type of roll form tooling on each side and the joint interface is the same for the interior of the connection and also the exterior.

Figure 7:
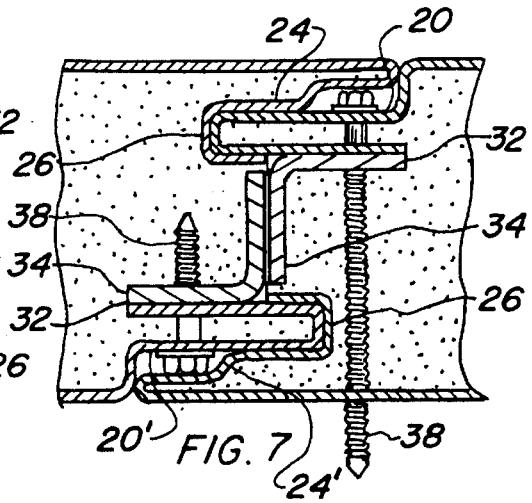
FIG. 7 is a cross-sectional view taken along lines 7—7 of FIG. 1 illustrating a second embodiment of the panel connection with two angle reinforcing splines added.
Figure 8:
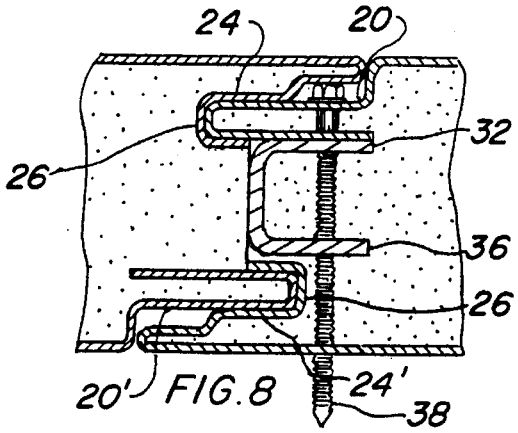
FIG. 8 is a cross-sectional view taken along lines 8—8 of FIG. 1 illustrating a second embodiment of the panel connection with a channel reinforcing spline added.
Figure 9:
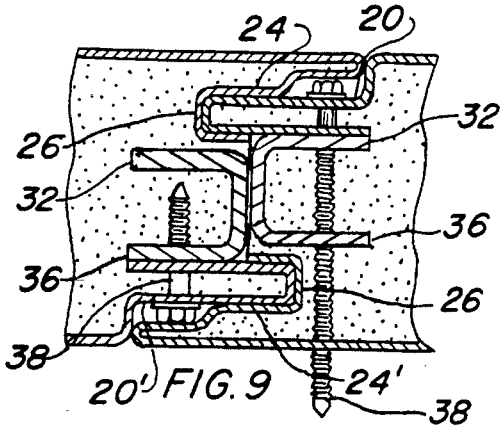
FIG. 9 is a cross-sectional view taken along lines 9—9 of FIG. 1 illustrating a second embodiment of the panel connection with two channel reinforcing splines added.

This embodiment again uses an identical reinforcing spline 32 in both the angle 34 and the channel 36 configurations, however, as one leg of the spline is attached through the channel shaped projection 20, the mirror image projection 20' may also have a spline 32 added in like manner. This construction ultimately doubles the strength of the reinforcement, as two angles 34 or channels may be used in each connecting joint, as shown in FIGS. 7 and 9. The attaching means and caulking are also duplicated for this second embodiment.

Figure 10:
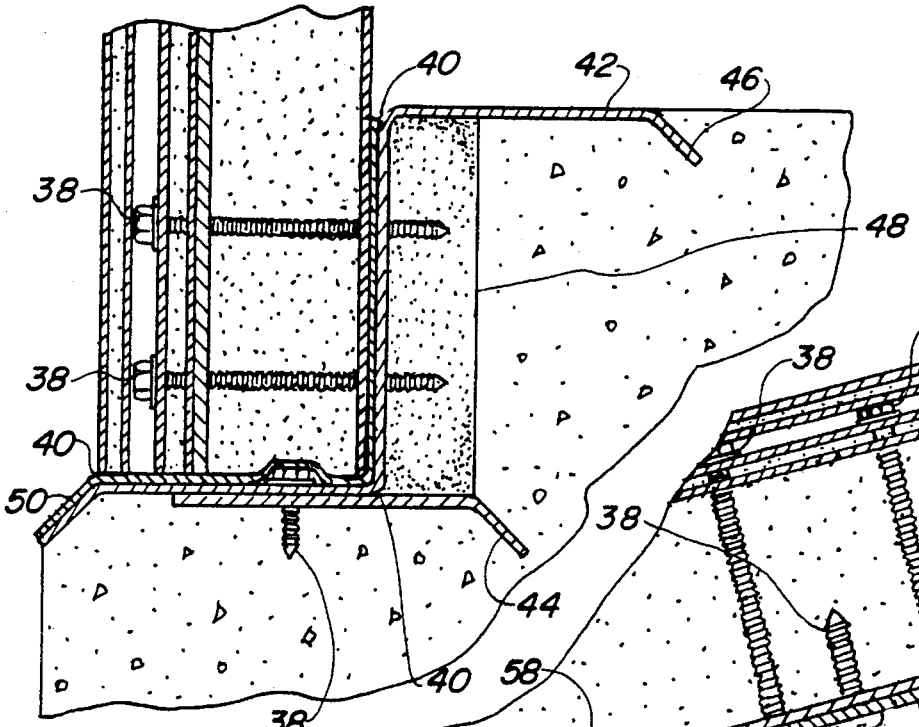
FIG. 10 is a cross-sectional view of the panel to floor connection.

The panel to floor connection is illustrated in FIG. 10 and may be used for both a concrete slab floor and a foundation wall with equal ease. The bottom of the structural composite panels that have been joined, as described above, rest on a Z-shaped metal section 42 having inwardly protruding ends and an anchor member 44 attached on a lower horizontal leg of the Z-section 42. The inner surface of the Z-section 42 is positioned touching the concrete and an upper protruding end 46, along with the anchor member 44, are embedded into the concrete and prevent so-called "up-lift" of the panel walls. The anchor member 44 is attached to the section 42 by a threaded fastener 38, as illustrated in FIG. 10, or welding, or other methods well known in the art. The joined panels are attached to the section 42 on the bottom end using attaching means in the form of a number of self-drilling and tapping threaded fasteners 38 penetrating both legs of the channel shaped projection 20. As it may be clearly seen in FIGS. 6 through 9, the head of the fastener is concealed in a space between the panel leg 24 and panel projection 20 and the other end of the fastener penetrates completely through the Z-shaped metal section 42. Further, pertaining to the panel to floor connection, in order for the fastener 38 to penetrate far enough to clear the self-drilling and tapping end of the fastener, an insulating block 48 is positioned between the vertical side of the Z-section 42 and the concrete floor leaving a space between the solid structural materials. A secondary purpose is to thermally isolate the panels from the floor. In some instances it is desirable or even mandated to employ a flashing 50 between the Z-section and the panel for insect protection. Caulking 40 is used at the interior interface and at exposed joints to form a vapor tight seal. While a slab floor is illustrated in FIG. 10, the same elements and procedures are used in a foundation wall.

Figure 11:
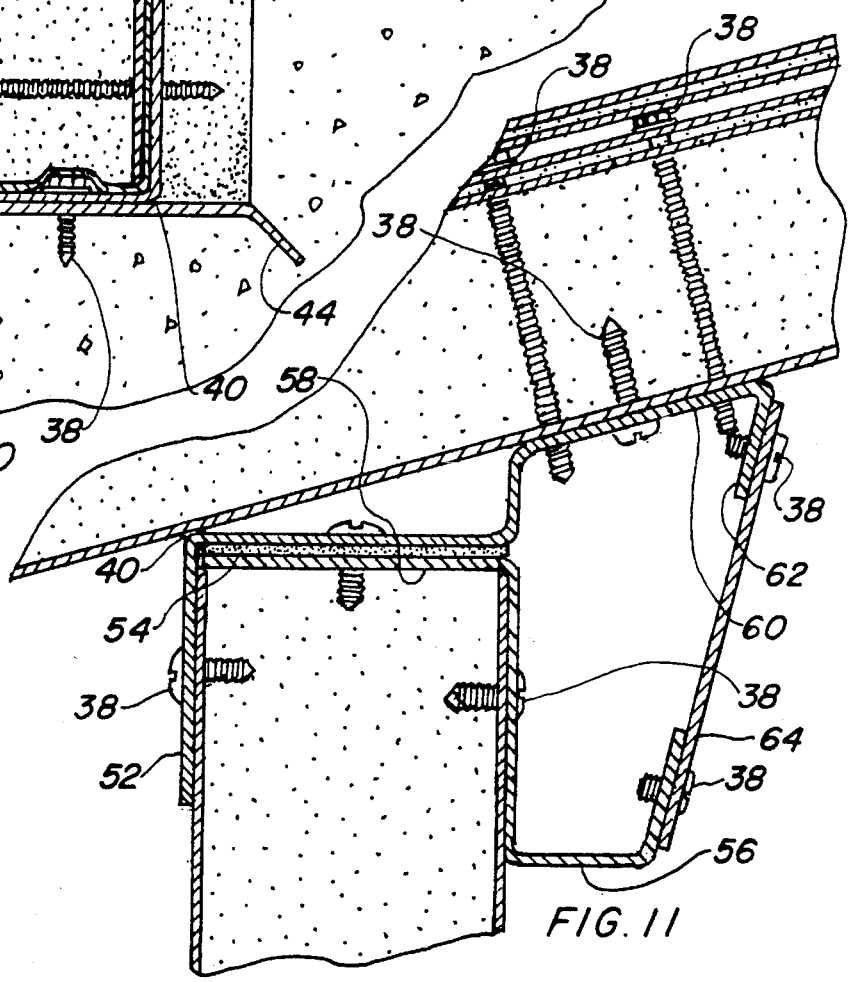
FIG. 11 is a cross-sectional view of the panel to roof connection.

FIG. 11 illustrates the panel to roof connection which uses a wireway trough 56 having an integral horizontal leg 58 which rests on top of the panel. The remainder of the wireway 56 is formed into a channel like trough with the upper portion open, this being capable of receiving and retaining electrical and electronic wires and cables. A thermobreak strip 54 is placed on top of the horizontal leg 58 of the wireway trough 56 to prevent thermal feedthrough of the joint. A roof mounting shelf 60 is positioned above the horizontal leg 58 of the trough 56 and provides a mounting platform to receive the roof panels. The shelf 60 has an integral angle member 52 and downwardly extending finger 62 aligned with the trough 56 inside the structure. This arrangement of two aligned surfaces inside permits a cover 64 to be added for protection and visual appearance. It should be noted that the extending finger 62 may also be in the form of a separate acute angle attached to the shelf 60 performing the same function as the integral finger 62. The integral angle member 52 is located on the outside surface of the panel and provides rigidity to the connection as well as enclosing the thermobreak strip 54. Again, threaded fasteners 38 penetrate the elements of this connection depicted in FIG. 11 to structurally bind them together and caulking 40 is also applied between the joined panels and the joint to form a vapor tight seal.

Figure 12:
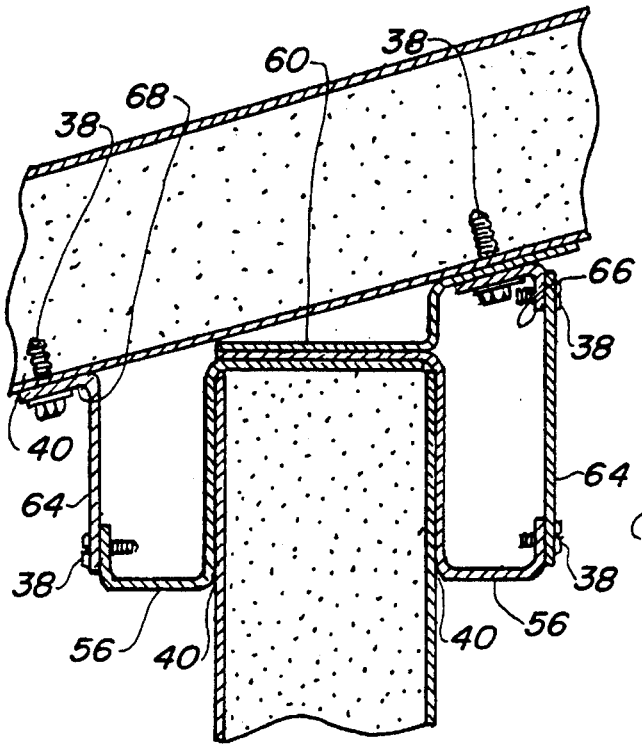
FIG. 12 is a cross-sectional view of the panel to roof connection in another embodiment.
Figure 13:
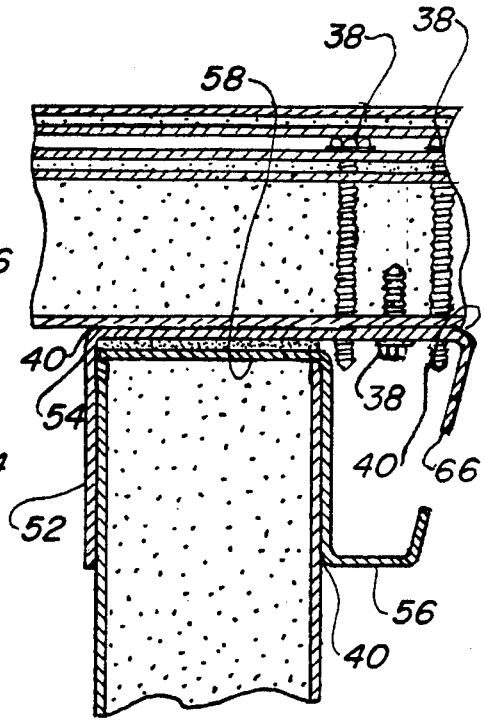
FIG. 13 is a cross-sectional view of the panel to roof connection within a flat roof embodiment.

FIGS. 12 and 13 show slightly different embodiments of the panel to roof connection. FIG. 12 depicts a connection using a wireway trough 56 on both the external and internal surface of the panel. This figure illustrates the separate cover connecting angle 66 described previously. The angle 66 in this embodiment is attached to the shelf 60 by screwing, however, other methods of attachment, such as welding are equally well employed. Another embodiment of the cover 64 is shown in FIG. 12 on the external surface where a flange 68 is bent into the cover and attached directly to the roof panel. FIG. 13 depicts a flat roof construction, therefore, the shelf 60 is omitted, however, the other elements remain the same. A formed channel 63 is positioned above the thermobreak strip 54 and horizontal leg 58 of the wireway trough 56 and one leg of the channel overlaps and encloses the strip 54 beneath on the outside. A threaded fastener 38 penetrates the roof panel and channel 63 providing integrity to the joint. Although not illustrated, a cover 64 may be screwed to the angled leg of the channel 63 and the upstanding leg of the trough 56.

Figure 14:
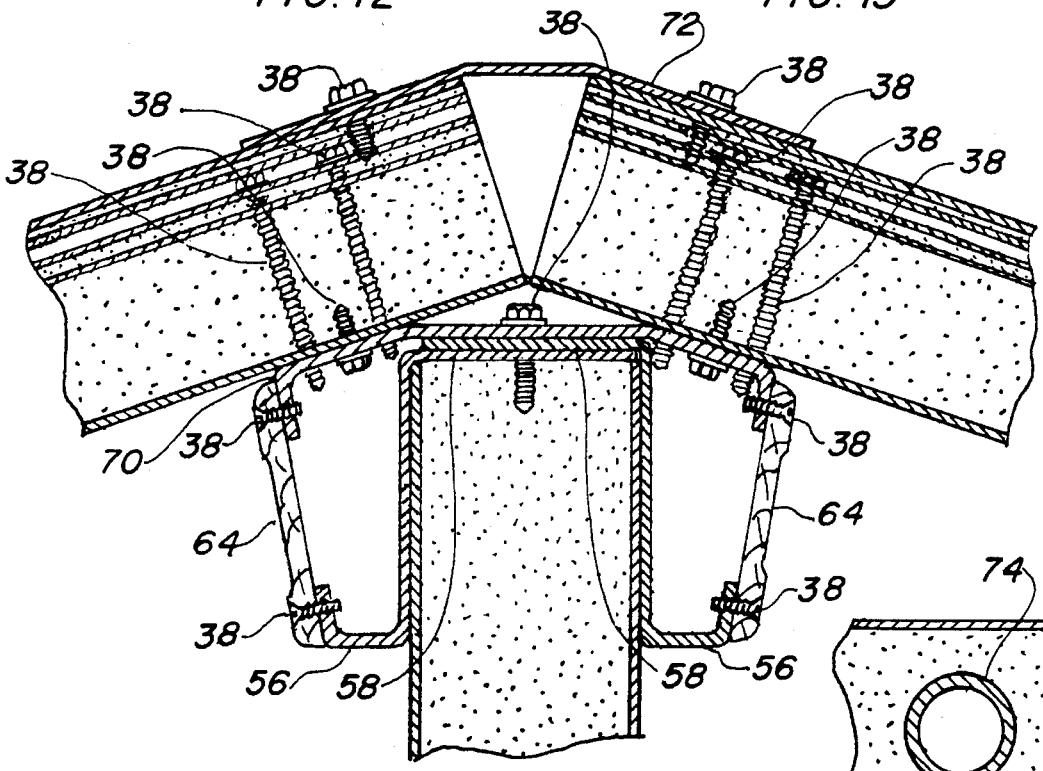
FIG. 14 is a cross-sectional view of the panel to roof ridge connection.

FIG. 14 illustrates a panel to roof ridge or beam connection which utilizes a pair of wireway troughs 56, one on each side of the supporting wall panel. Each trough 56 is formed with a horizontal leg on the top and a parallel, but opposed, leg on the bottom in the shape of a Z. The bottom leg further contains an upwardly directed lip that forms the wire receiving portion. A pair of troughs 56 are used oppositely with the horizontal legs contiguously overlapping and united with the top of the panel, as illustrated. An inside formed roof connector 70, angled downward on each end and bent in the middle to correspond to the roof pitch, is positioned on top of the troughs horizontal legs 58. Again, threaded fasteners 38 secure the joint and attach the roof panels to the connector 70. An outside formed roof connector 72, also angled downward on each end, is placed over the joint connection and fastened on the outside surface to the joined panels with threaded fasteners 38 creating a closure between panels, also forming the apex of the roof. Again, caulking 40 is used on the open joints to assure sealing integrity.

Figure 15:
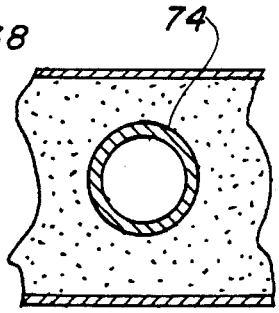
FIG. 15 is a cross-sectional view taken along lines 15—15 of FIG. 1 illustrating an electrical conduit in the center of a panel.

FIG. 15 illustrates an electrical conduit 74 in the center of the panel.

While each connection of the system is illustrated and described individually, the entire system or any of the combination of the connection by itself is inherently the invention and, as such, is not limited to all details since many changes and modifications may be made in the invention without departing from the spirit and scope thereof. Hence, the invention is described to cover any and all modifications and forms which may come within the language and scope of the appended claims.

What is claimed is:

1. A structural insulated building panel system assembled from individual structural composite panels having an insulating foam core sandwiched between an outside metal skin and an inside metal skin, the system defining a panel to panel connection comprising:

a channel shaped projection integral with a panels outside skin on a first end, a channel shaped extension joggled away from an inside skin on a first end of a panel opposite the projection within a same panel end forming male junction members, an outwardly protruding U-shaped leg extending parallel from a second end of a panel outside skin having a joggle formed into the leg away from an outside skin, also a female recess integrally formed into a panel skin such that when a panel first end and an adjacent panel second end are joined together, the projection interfaces with the recess to form a slip fit structural joint and the joggled leg provides a space between the leg and the projection, and an inwardly contoured overlapping Z-shaped finger formed integrally from a second end of a panel inside skin, the panels insulating foam configured parallel with the extended finger such that a socket is formed between the foam and the finger in a panel skin, the socket interfacing with the extension to form a male and female joint when a panel first end and a panel second end are joined together.

2. The system panel to panel connection as recited in claim 1 further comprising a reinforcement spline embedded into a insulating foam core contiguous with a channel shaped projection for augmenting structural integrity of a joint.

3. The system panel to panel connection as recited in claim 2 wherein said reinforcement spline further comprises a channel cut an appropriate length, on site, and inserted into a foam core, and a plurality of fasteners connecting completely through the channel shaped extension on the first end of an inside panel into one leg of the channel.

4. The system panel to panel connection as recited in claim 2 wherein said reinforcement spline further comprises an angle cut an appropriate length on site and inserted into a foam core, and a plurality of fasteners connecting through the channel shaped extension on the first end of a panel into one leg of the angle.

5. The system panel to panel connection as recited in claim 1 further comprising caulking at a corner interfacing the projection to the recess, also where a visual joint is made.

6. A structural insulated building panel system assembled from individual structural composite panels having an insulating foam core sandwiched between an outside metal skin and an inside metal skin, the system defining a panel to panel connection comprising:

a channel shaped projection integral with an outside panel skin on a first end of a panel, a U-shaped leg extending parallel from an inside skin on a first end of a panel having a joggle formed into the leg away from the inside skin, also a female recess integrally formed into the inside skin, an outwardly protruding U-shaped leg extending parallel from an opposite outside skin on a second end of a panel having a joggle formed into the leg away from an outside skin, also a female recess integrally formed in the same panel skin such that when a panel first end and a panel second end are joined together, the projection interfaces with the recess to form a slip fit structural joint and the U-shaped joggled leg provides a space between the leg and the projection, and an inwardly extending channel shaped projection integral with an inside panel skin on a second end of a panel such that when a panel first end and an adjacent panel second end are joined together, the projection interfaces with the recess to form a slip fit structural joint and the U-shaped joggled leg providing a space between the leg and the projection, further making a panel first end a direct opposite mirror image of a panel second end, causing each panel to be unidirectional inside and outside.

7. The system panel to panel connection as recited in claim 6 further comprising a reinforcement spline embedded into an insulating foam core contiguous with at least one channel shaped projection for augmenting structural integrity of a joint.

8. A structural insulated building panel system assembled from individual structural composite panels having an insulating foam core sandwiched between an outside metal skin and an inside metal skin, the system defining a panel to floor connection comprising:

a Z-shaped metal section having horizontal legs and an anchor member attached on a lower horizontal leg of the Z-section with an inner surface of the Z-section positioned contiguous with an upper protruding end of a concrete floor and the anchor member attachably positioned within the floor, and structural composite panels joined on a bottom end to the Z-section with attaching means, and an insulating block disposed between a vertical side of the Z-section and a concrete floor for thermally isolating panels from a floor and to provide space for attaching means to jointly penetrate a panel and the Z-section.

9. The system panel to floor connection as recited in claim 8 wherein said attaching means further comprise a plurality of self-drilling and tapping threaded fasteners with each fastener head concealing within a panel and a threaded portion of each fastener penetrating a panel and the Z-section, thus forming a structural compression joint.

10. The system panel to floor connection as recited in claim 8 further comprising a flashing between the Z-section and a panel for insect protection, and caulking between the Z-section and a panel on exposed joints to form a vapor tight seal.

11. A structural insulated building panel system assembled from individual structural composite panels having an insulating foam core sandwiched between an outside metal skin and an inside metal skin, the system defining a panel to roof connection comprising:

a wireway trough having an integral horizontal leg disposed on an interior upper surface of joined panels, a thermobreak strip disposed contiguously with a top surface of the wireway trough integral horizontal leg to reduce thermal feedthrough, a roof mounting shelf abutting the thermobreak strip over joined panels providing a mounting platform to receive roof panels, the shelf having a downwardly extending finger aligned with the trough, the combination providing a structural panel to roof connection, also an integral wireway for retaining electrical and electronic wires and cables.

12. The system panel to roof connection as recited in claim 11 further comprising a cover fastened to both the wireway trough and the shelf extending finger for enclosing the wireway for protection and visual appearance.

13. The system panel to roof connection as recited in claim 11 further comprising a plurality of threaded fasteners penetrating the thermobreak strip, trough and shelf, connecting said elements together along with associated composite panels forming the panel to roof connection.

14. The system panel to roof connection as recited in claim 11 further comprising caulking between joined panels and elements comprising a roof joint to form a vapor tight seal.

15. A structural insulated building panel system assembled from individual structural composite panels having an insulating foam core sandwiched between an outside metal skin and an inside metal skin, the system defining a panel to roof ridge connection comprising:

a pair of opposed wireway troughs one on each side of a plurality of joined panels, each trough having an integral horizontal leg contiguously mounted on each other on a panel top surface, an inside formed roof connector, angled downward on each end appropriately to conform to a specific roof pitch, juxtapositioned and fastened to the wireway troughs forming a mounting surface for roof panels, and an outside formed roof connector, angled on each end appropriately to conform to a specific roof pitch juxtapositioned and fastened on an outside surface of a plurality of joined roof panels creating a closure between panels and forming a roof apex.

16. The system panel to roof ridge connection as recited in claim 15 further comprising a cover fastened to a wireway trough for enclosing and to provide protection and visual appearance.

17. The system panel to roof ridge connection as recited in claim 15 further comprising a plurality of threaded fasteners penetrating the troughs, and formed roof connectors connecting said elements together to composite wall and roof panels forming the panel to roof ridge connection.

18. A structural insulated building panel system assembled from individual structural composite panels having an insulating foam core sandwiched between an outside metal skin and an inside metal skin, the system comprising:

a panel to panel connection having, opposing male and female joining means integral with each mating panel, a panel to floor connection having, a Z-shaped section having horizontal legs and an anchor member attached on a lower horizontal leg of the Z-section with an inner surface of the Z-section positioned contiguous with an upper protruding end of a concrete floor and the anchor member attachably positioned within the floor, structural composite panels joined on a bottom and lower side to the Z-section with attaching means, a panel to roof connection having, a wireway trough having an integral horizontal leg disposed on an inside upper surface of joined panels, a thermobreak strip disposed contiguously with a top surface of the wireway trough integral horizontal leg to reduce thermal feedthrough, a roof mounting shelf abutting the thermobreak strip over joined panels providing a mounting platform to receive roof panels, the shelf having a downwardly extending finger aligned with the trough, the combination providing a structural panel to roof connection, also an integral wireway for retaining, electrical and electronic wires and cables, and a panel to roof ridge connection having, a pair of opposed wireway troughs, one on each side of a plurality of joined panels, each wireway trough having an integral horizontal leg contiguously mounted on each other on a panel top surface, an inside formed roof connector, angled on each end appropriately to conform to a specific roof pitch, juxtapositioned and fastened to a wireway trough forming a mounting surface for roof panels, an outside formed roof connector, angled on each end appropriately to conform to a specific roof pitch juxtapositioned and fastened on an outside surface of a plurality of joined roof panels creating a closure between panels and forming a roof apex.

19. The structural insulated building panel system as recited in claim 18 wherein said opposing male and female joining means further comprise:

an inwardly extending channel shaped projection integral with the outside skin on a first end of a panel, an inwardly extending channel shaped extension joggled away from the outside skin on a first end of a panel opposite the projection within the same panel end forming male junction members, an outwardly protruding U-shaped leg extending parallel from a second end of a panel outside skin having a joggle formed into the leg away from an outside skin, also a female recess integrally formed into a panel skin such that when a panel first end and adjacent panel second end are joined together, the projection interfaces with the recess to form a slip fit structural joint and the joggled leg provides a space between the leg and the projection, and an inwardly contoured overlapping Z-shaped finger formed integrally from a second end of a panel inside skin, with insulating foam configured parallel with the extended finger, such that a socket is formed between the foam and the finger in a panel skin, the socket interfacing with the extension.

20. The structural insulated building panel system as recited in claim 19 further comprising a reinforcement spline embedded into a insulating foam core contiguous with the channel shaped projection for augmenting the structural integrity of a joint.

21. The structural insulated building panel system as recited in claim 19 further comprising:

a channel shaped projection integral with an outside panel skin on a first end of a panel, a U-shaped leg extending parallel from an inside skin on a first end of a panel having a joggle formed into the leg away from the inside skin, also a female recess integrally formed into the skin, an outwardly protruding U-shaped leg extending parallel from an opposite outside skin on a second end of a panel having a joggle formed into the leg away from an outside skin, also a female recess integrally formed in the same panel skin, such that when a panel first end and a panel second end are joined together, the projection interfaces with the recess to form a slip fit structural joint and the U-shaped joggled leg provides a space between the leg and the projection, and an inwardly extending channel shaped projection integral with an inside panel skin on a second end of a panel such that when a panel first end and a panel second are joined together, the projection interfaces with the recess to form a slip fit structural joint and the U-shaped joggled leg providing a space between the leg and the projection, further making a panel first end a direct opposite mirror image of a panel second end, causing each panel to be multi-directional inside and outside.

22. The structural insulated building panel system as recited in claim 21 further comprising a reinforcement spline embedded into a panel insulating foam core contiguous with the channel shaped projection for augmenting the structural integrity of a joint.

* * * * *